US009576487B2

(12) United States Patent
Chu et al.

(10) Patent No.: US 9,576,487 B2
(45) Date of Patent: Feb. 21, 2017

(54) GLOBAL POSITIONING SYSTEM

(71) Applicants: Kevin Hwading Chu, Houston, TX (US); Yangyang Chen, Houston, TX (US); Xiran Wang, Houston, TX (US)

(72) Inventors: Kevin Hwading Chu, Houston, TX (US); Yangyang Chen, Houston, TX (US); Xiran Wang, Houston, TX (US)

(73) Assignee: Intellectual Fortress, LLC, Houston, TX (US)

( * ) Notice: Subject to any disclaimer, the term of this patent is extended or adjusted under 35 U.S.C. 154(b) by 0 days.

(21) Appl. No.: 14/858,011

(22) Filed: Sep. 18, 2015

(65) Prior Publication Data

US 2016/0307443 A1 Oct. 20, 2016

Related U.S. Application Data

(63) Continuation of application No. 14/705,728, filed on May 6, 2015, now Pat. No. 9,165,461, and a (Continued)

(51) Int. Cl.

| | |
|---|---|
| ***G08G 1/08*** | (2006.01) |
| ***G08G 1/01*** | (2006.01) |
| ***G08G 1/02*** | (2006.01) |
| ***G08G 1/04*** | (2006.01) |
| ***G08G 1/065*** | (2006.01) |
| ***G08G 1/081*** | (2006.01) |
| ***G08G 1/087*** | (2006.01) |

(Continued)

(52) U.S. Cl.

CPC ..... *G08G 1/08* (2013.01); *G08G 1/012* (2013.01); *G08G 1/0129* (2013.01); *G08G 1/0145* (2013.01); *G08G 1/02* (2013.01); *G08G 1/04* (2013.01); *G08G 1/065* (2013.01); *G08G 1/081* (2013.01); *G08G 1/087* (2013.01); *G08G 1/095* (2013.01); *G08G 1/096* (2013.01); *G08G 1/137* (2013.01)

(58) Field of Classification Search

CPC ... G08G 1/08; G08G 1/096725; G01S 17/936; G01C 21/3415; G01C 21/3492; B60R 25/305; G07C 5/085; H04N 1/00281; H04N 5/23212; G06K 9/6203; H04M 1/66; F02N 11/0837

USPC .... 701/117; 340/905, 539.13, 933; 348/148; 455/411; 235/375; 382/103

See application file for complete search history.

(56) References Cited

U.S. PATENT DOCUMENTS 6,195,019 B1 2/2001 Nagura
6,737,989 B2 5/2004 Flick
(Continued)

FOREIGN PATENT DOCUMENTS

CA 2302998 A1 9/2001

OTHER PUBLICATIONS

Office Action Issued in Related U.S. Appl. No. 14/705,728, Mailed Jun. 24, 2015 (20 pages).

(Continued)

*Primary Examiner* — Yuri Kan

(57) ABSTRACT

A global positioning system including a processor configured to determine a route of travel based upon satellite data that identify a current location of the global positioning system and traffic data obtained from a traffic flow control system, and a display configured to display the current position and a determined route of travel.

20 Claims, 8 Drawing Sheets

Related U.S. Application Data continuation-in-part of application No. 14/751,941, filed on Jun. 26, 2015, which is a continuation-in-part of application No. 14/690,717, filed on Apr. 20, 2015, now Pat. No. 9,243,741, and a continuation-in-part of application No. 14/714,349, filed on May 18, 2015.

(60) Provisional application No. 62/172,952, filed on Jun. 9, 2015.

(51) Int. Cl.

| | |
|---|---|
| ***G08G 1/095*** | (2006.01) |
| ***G08G 1/096*** | (2006.01) |
| ***G08G 1/137*** | (2006.01) |

(56) References Cited

U.S. PATENT DOCUMENTS

| | | | | |
|---|---|---|---|---|
| 7,973,675 | B2 | 7/2011 | Glatfelter | |
| 2002/0082806 | A1 | 6/2002 | Kaub | |
| 2005/0001024 | A1* | 1/2005 | Kusaka | H04N 1/00281 235/375 |
| 2005/0088320 | A1* | 4/2005 | Kovach | G07C 5/085 340/933 |
| 2006/0095195 | A1 | 5/2006 | Nishimura et al. | |
| 2007/0069920 | A1 | 3/2007 | Hakki et al. | |
| 2007/0100704 | A1 | 5/2007 | Liu et al. | |
| 2007/0174790 | A1 | 7/2007 | Jing et al. | |
| 2007/0290839 | A1* | 12/2007 | Uyeki | G01C 21/3415 340/539.13 |
| 2008/0152231 | A1 | 6/2008 | Gokturk et al. | |
| 2009/0240735 | A1 | 9/2009 | Grandhi et al. | |
| 2009/0256721 | A1 | 10/2009 | Glatfelter | |
| 2010/0057334 | A1* | 3/2010 | Ramaswamy | G01C 21/3492 701/117 |
| 2010/0158310 | A1 | 6/2010 | McQueen et al. | |
| 2010/0226532 | A1* | 9/2010 | Hayasaka | G06K 9/6203 382/103 |
| 2012/0047146 | A1 | 2/2012 | Balakrishnan et al. | |
| 2012/0124036 | A1 | 5/2012 | Ramos et al. | |
| 2013/0287261 | A1 | 10/2013 | Lee et al. | |
| 2014/0003727 | A1 | 1/2014 | Lortz et al. | |
| 2014/0118168 | A1* | 5/2014 | Lee | G08G 1/096725 340/905 |
| 2014/0162598 | A1* | 6/2014 | Villa-Real | H04M 1/66 455/411 |
| 2014/0210644 | A1* | 7/2014 | Breed | G01S 17/936 340/905 |
| 2014/0218523 | A1* | 8/2014 | Su | B60R 25/305 348/148 |
| 2014/0278998 | A1 | 9/2014 | Systrom et al. | |
| 2014/0279246 | A1 | 9/2014 | Chen et al. | |
| 2014/0309966 | A1 | 10/2014 | Cornu et al. | |
| 2014/0324326 | A1* | 10/2014 | Taylor | G08G 1/08 701/117 |
| 2014/0362215 | A1* | 12/2014 | Yoshio | H04N 5/23212 348/143 |
| 2016/0215747 | A1* | 7/2016 | Huber | F02N 11/0837 |

OTHER PUBLICATIONS

Notice of Allowance Issued in Related U.S. Appl. No. 14/705,728, Mailed Aug. 17, 2015 (11 pages).

Lowe, David, "Local Feature View Clustering for 3D Object Recognition", Proceedings of the Institute of Electrical and Electronics Engineers, Inc., Conference on Computer Vision and Pattern Recognition, Kauai, HI, Dec. 2001 (7 pages).

Lowe, David, "Object Recognition from Local Scale-Invariant Features", Proceedings of the International Conference on Computer Vision, Corfu, Greece, Sep. 1999 (8 pages).

* cited by examiner

GLOBAL POSITIONING SYSTEM

BACKGROUND

The Global Positioning System is a satellite-based navigation system that provides location and time information in all weather conditions. Satellite data that are combined with local traffic flow control data advantageously provide more accurate routing information, ETA information, etc.

SUMMARY

In general, in one aspect, one or more embodiments disclosed herein relate to a global positioning system comprising: a processor configured to determine a route of travel based upon satellite data that identify a current location of the global positioning system and traffic data obtained from a traffic flow control system; and a display configured to display the current position and a determined route of travel.

In another aspect, one or more embodiments disclosed herein relate to a method comprising: receiving satellite data; determining a route of travel based on the satellite data; receiving a traffic data from a traffic flow control system; modifying the route of travel using the traffic data; and displaying a current location and a modified route of travel.

In yet another aspect, one or more embodiments disclosed herein relate to a non-transitory computer readable medium comprising computer readable program code, which when executed by a computer processor, enables the computer processor to: receive satellite data; determine a route of travel based on the satellite data; receive a traffic data from a traffic flow control system; modify the route of travel using the traffic data; and cause a current location and a modified route of travel to be displayed on a display.

Other aspects and advantages of the invention will be apparent from the following description and the appended claims.

BRIEF DESCRIPTION OF DRAWINGS

FIG. 5 shows an example city grid layout in which a first type computing device according to one or more embodiments of the invention can be deployed in.

DETAILED DESCRIPTION

Figure 1A:
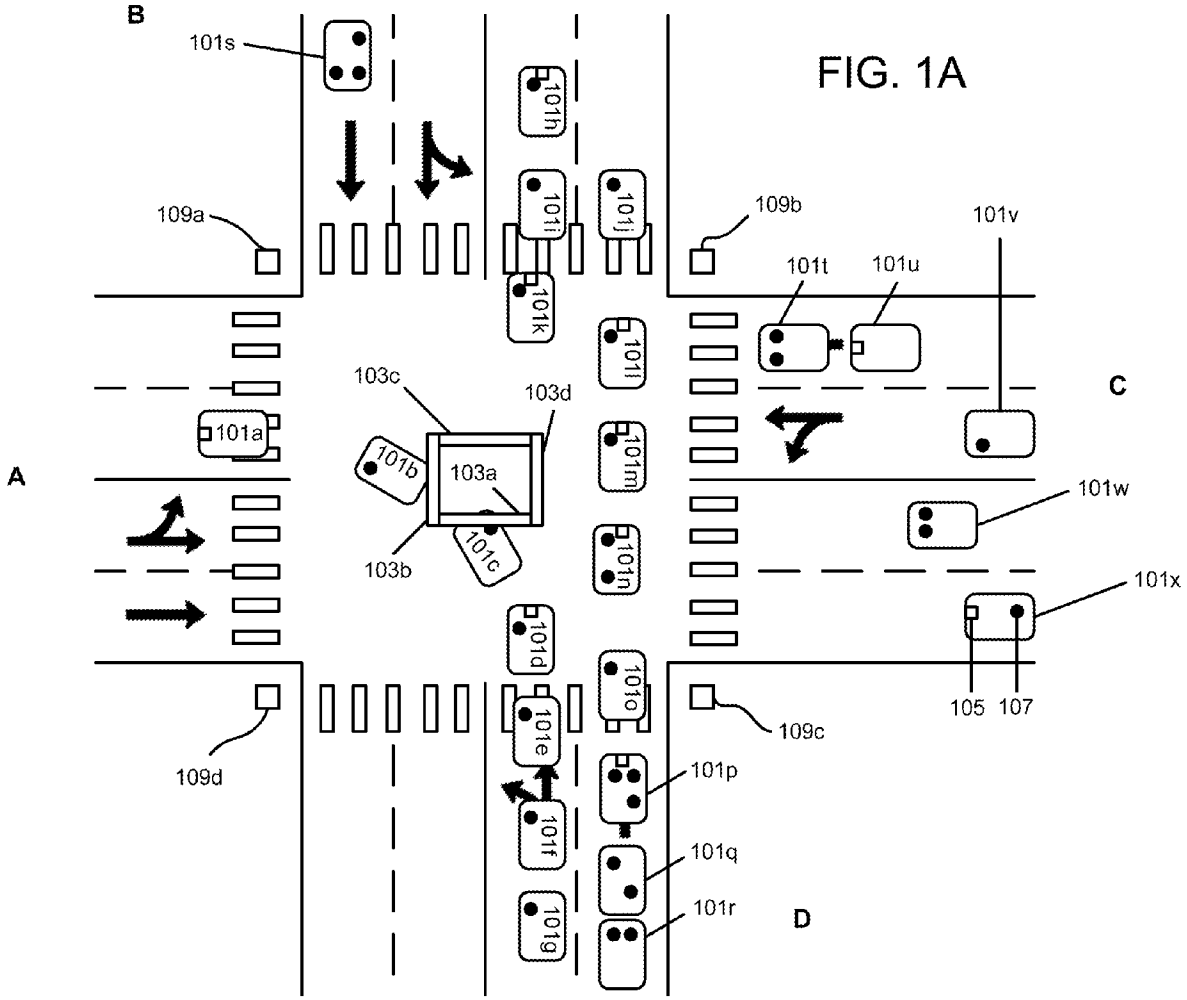
FIG. 1A shows a traffic flow control system according to one or more embodiments of the invention applied to an intersection.

Specific embodiments will now be described in detail with reference to the accompanying figures. Like elements in the various figures are denoted by like reference numerals for consistency. Like elements may not be labeled in all figures for the sake of simplicity.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create a particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a", "an", and "the" include plural referents unless the context clearly dictates otherwise. Thus, for example, reference to "a vehicle" includes reference to one or more of such vehicles. Further, it is to be understood that "or", as used throughout this application, is an inclusive or, unless the context clearly dictates otherwise.

Terms like "approximately", "substantially", etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

In general, embodiments of the invention relate to a global positioning system. In general, embodiments of the invention relate to a method for displaying a current location and a route of travel. In general, embodiments of the invention relate to a non-transitory computer readable medium comprising computer readable program code, which when executed by a computer processor, enables the computer processor to cause a current location and a route of travel to be displayed on a display.

FIG. 1A shows a traffic flow control system according to one or more embodiments of the invention applied to an intersection. FIG. 1A shows vehicles (101*a*-101*x*), each of which may comprise a first type computing device (107) and a second type computing device (105). FIG. 1A also shows display devices (103*a*-103*d*) and user interactive devices (109*a*-109*d*). Each of these components is described below.

In one or more embodiments of the invention, the first type computing device (107) may be a smart phone, a global positioning system, a laptop, a tablet computer, an electronic reader (e-reader), a cable box, a kiosk, a server, a mainframe, a desktop personal computer, a personal digital assistant (PDA), or any other type of hardware device.

In one or more embodiments of the invention, the second type computing device (105) may be a smart phone, a global positioning system, a laptop, a tablet computer, an electronic reader (e-reader), a cable box, a kiosk, a server, a mainframe, a desktop personal computer, a personal digital assistant (PDA), or any other type of hardware device.

In one or more embodiments of the invention, the first type computing device (107) is different from the second type computing device (105).

In one or more embodiments of the invention, the display devices (103*a*-103*d*) may be traffic lights for pedestrians, bicycles, cars, trains, cargos, ferries, planes, or any other mode of transportation requiring signaling.

In one or more embodiments of the invention, the user interactive devices (109*a*-109*d*) may be panels each having at least a button (not shown) for pedestrians to press to express interest in crossing at the intersection and a plurality of display icons. In one or more embodiments of the invention, the user interactive devices may be used to signal pedestrians, cyclers, etc.

One of ordinary skill in the art would appreciate that FIG. 1A is a mere example and that the number, shape, size, orientation, etc., of vehicle, display device, user interactive device, first type computing device, second type computing device, etc., of the system can vary from one embodiment to another without departing from the spirit of the invention.

FIG. 1A shows a four-way (forks A-D) intersection having 16 travel directions (4 forks*(go straight+turn right+turn left+U-turn)). However, in one or more embodiments of the invention, only 8 of the 16 travel directions (4 forks*(go straight+turn left)) require regulation by the display devices. One of ordinary skill in the art would appreciate that "turn right" may be possible when the display device signals "go straight." One of ordinary skill in the art would appreciate that "turn right" may be possible when the display device does not signal "go straight." One of ordinary skill in the art would appreciate that "U-turn" may be possible when the display device signals "turn left." In one or more embodiments, pedestrian crossings may constitute additional travel directions.

FIG. 1A shows that the "go straight" and the "turn left" signals are available to vehicles (101*e*-101*g*), for example. That is, travel directions DA and DB (travel direction from D to A, from D to B, etc.) are flowing. All other vehicles that are not signaled to "go straight" or "turn left" are restricted from travel, but may, on the right occasion, "turn right." For example, the vehicle (101*t*) does not have the right of way, but may "turn right" from fork C to fork B on the right occasion. That is, the vehicle (101*t*) may travel in the CB flow on the right occasion.

Figure 3:
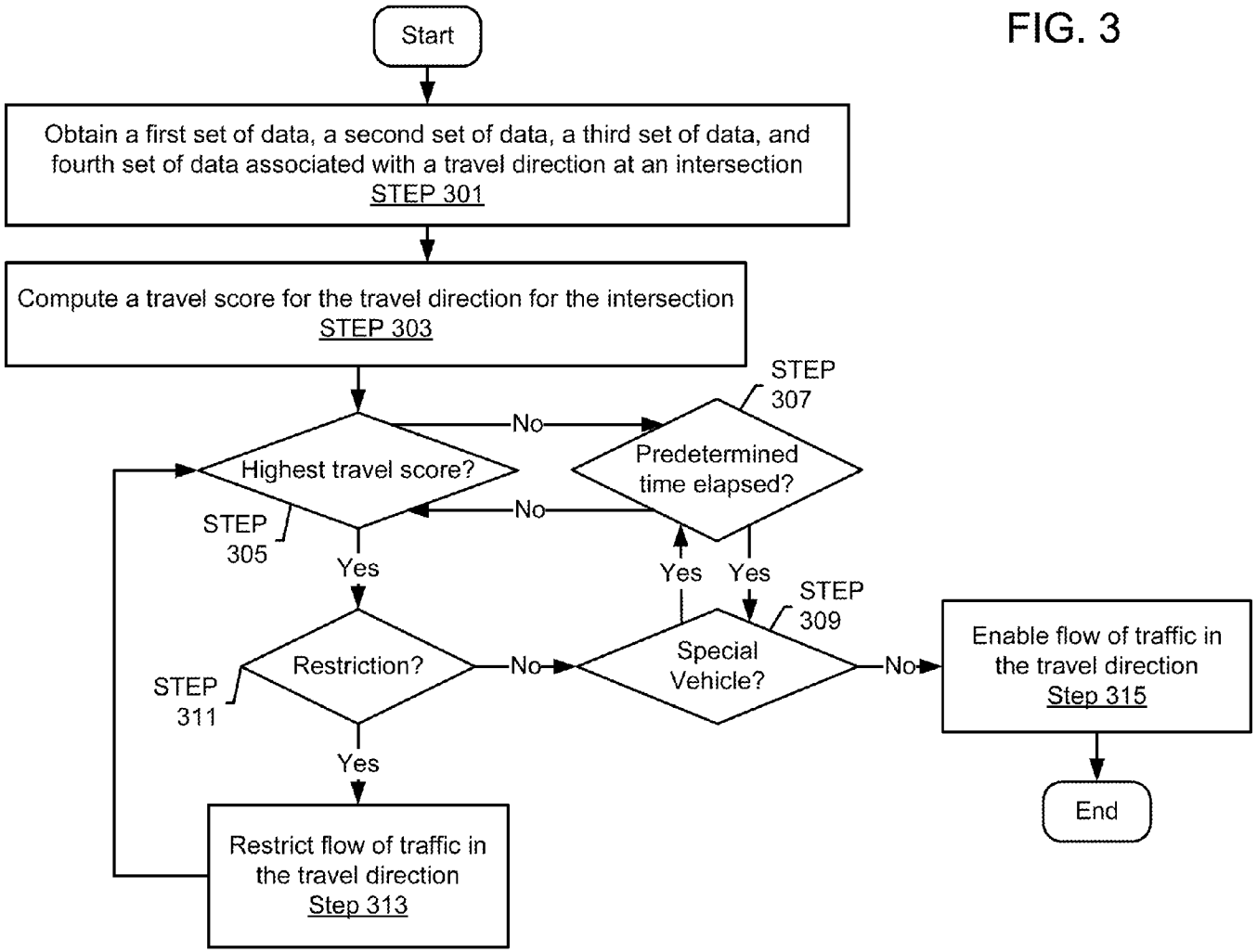
FIG. 3 shows a traffic flow control method according to one or more embodiments of the invention.

More details regarding the traffic flow control method as applied to, for example, the traffic flow control system shown in FIG. 1A is discussed in reference to FIG. 3.

Figure 1B:
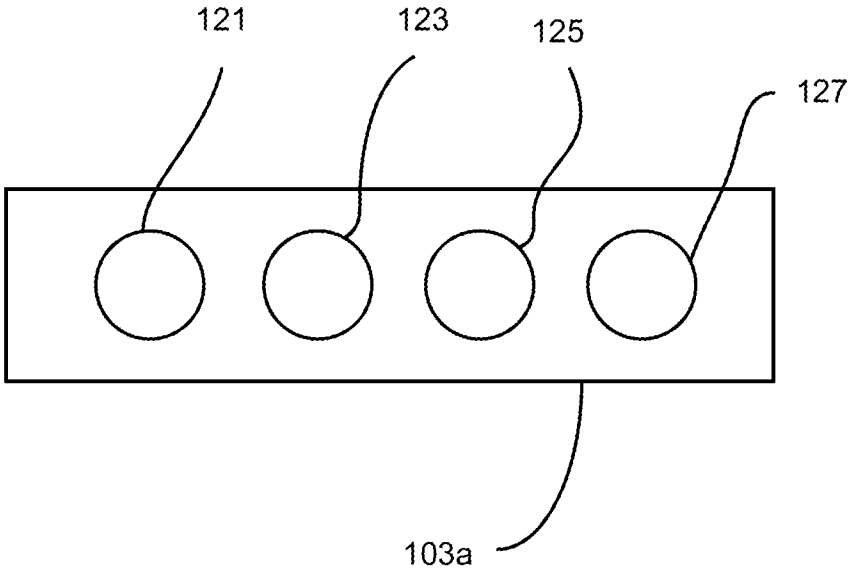
FIG. 1B shows a display device of a traffic flow control system according to one or more embodiments of the invention.

FIG. 1B shows a display device of a traffic flow control system according to one or more embodiments of the invention. FIG. 1B shows a display device that regulates traffic at an intersection. FIG. 1B shows the display device (103*a*) having a left turn signal (121), a green light (123) that signals "go straight," an amber light (125) that signals that the display device (103*a*) is about to place restriction on the travel direction, and a red light (1.27) that restricts travel in the travel direction.

Figure 1C:
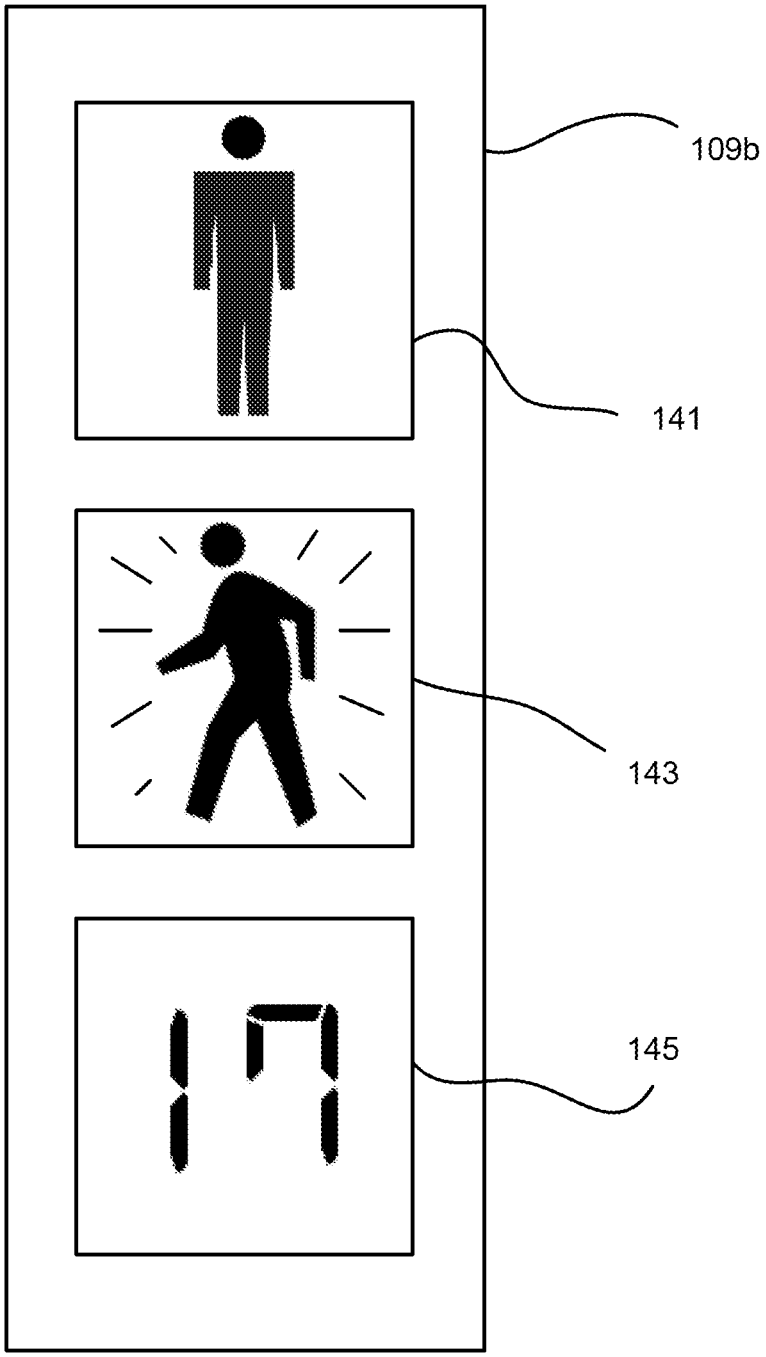
FIG. 1C shows a user interactive device of a traffic flow control system according to one or more embodiments of the invention.

FIG. 1C shows an user interactive device of a traffic flow control system according to one or more embodiments of the invention. The user interactive device (109*b*) may comprise display icons—a stop sign (141), a go sign (143), a countdown timer (145) that indicates how long until the stop sign (141) changes to the go sign (143), and vice versa. In FIG. 1C, an example of the go sign (143) being illuminated is shown. Additionally, a countdown timer (145) counts down until when the go sign (143) is to switch to the stop sign (141). FIG. 1C shows that in 17 seconds, the go sign (143) will cease to illuminate and the stop sign (141) will begin to illuminate. In one or more embodiments, the user interactive device (109*b*) may comprise a panel having at least one button for pedestrians to press, thereby expressing interest in crossing at the intersection. A plurality of buttons may be provided to differentiate between those pedestrians wishing to cross from the user interactive device (109*c*) to the user interactive device (109*b*) and those pedestrians wishing to cross from the user interactive device (109*c*) and the user interactive device (109*a*). In one or more embodiments, depending on demand (which could be obtained by using the third set of data (see below), for example), the traffic flow control system may enable pedestrian crossings from the user interactive device (109*c*) to the user interactive device (109*a*), and vice versa and enable pedestrian crossings from the user interactive device (109*b*) to the user interactive device (109*d*), and vice versa.

Figure 2A:
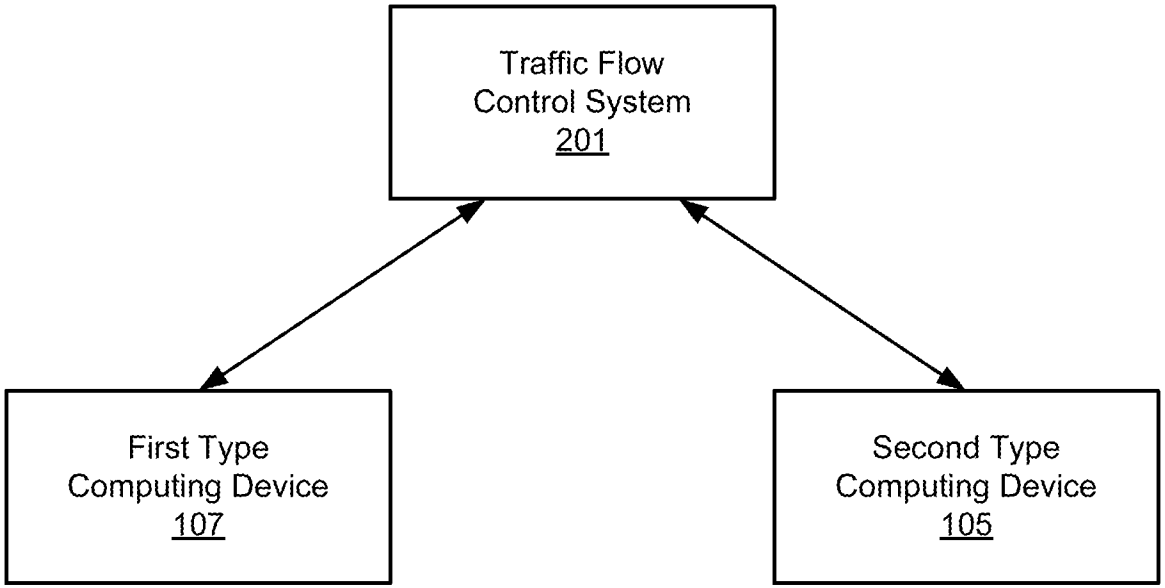
FIG. 2A shows a traffic flow control system according to one or more embodiments of the invention.

FIG. 2A shows a traffic flow control system according to one or more embodiments of the invention. The traffic flow control system (201) may comprise display devices (103*a*-*d*), an image acquisition module (not shown) configured to be mounted on or in the vicinity of the display devices (103*a*-*d*), user interactive devices (109*a*-*d*), and a server. The various components may communicate to one another either wired- or wirelessly.

In one or more embodiments of the invention, the traffic flow control system (201) is configured to receive a first set of data from a first type computing device (107) and a second set of data from a second type computing device (105).

In one or more embodiments of the invention, the first set of data may comprise a count of the first type computing device (107) at, or near, fork A, for example. In one or more embodiments of the invention, the first set of data may comprise a speed at which the first type computing device (107) is approaching fork A, for example.

In one or more embodiments of the invention, the second set of data may comprise a count of the second type computing device (105) at, or near, fork A, for example. In one or more embodiments of the invention, the second set of data may comprise a speed at which the second type computing device (107) is approaching fork A, for example. In one or more embodiments of the invention, the second set of data may comprise a destination and/or route information of the second type computing device (107).

Returning to FIG. 1A for purposes of illustration only, various methods may help the traffic flow control system (201) determine that no first type computing device (107) and no second type computing device (105) is at fork A. Likewise, various methods may help the traffic flow control system (201) determine that there are 3 first type computing devices (107) and 1 second type computing device (105) waiting for right of way at fork C, etc., for example. Of course, there may be more first type computing devices (107) being carried by pedestrians in proximity to fork C. However, as discussed above, the third set of data may include a count of pedestrians located in proximity to fork C, for example, and adjust a travel score (to be explained in reference to FIG. 3) accordingly to differentiate between those computing devices that are within vehicles and those computing devices that belong to pedestrians.

Some of the various methods may be: global positioning system, assisted global positioning system, synthetic global positioning system, cellular identification, wireless fidelity, inertial sensors, barometers, ultrasonic, Bluetooth beacons, terrestrial transmitters, etc.

Figure 2B:
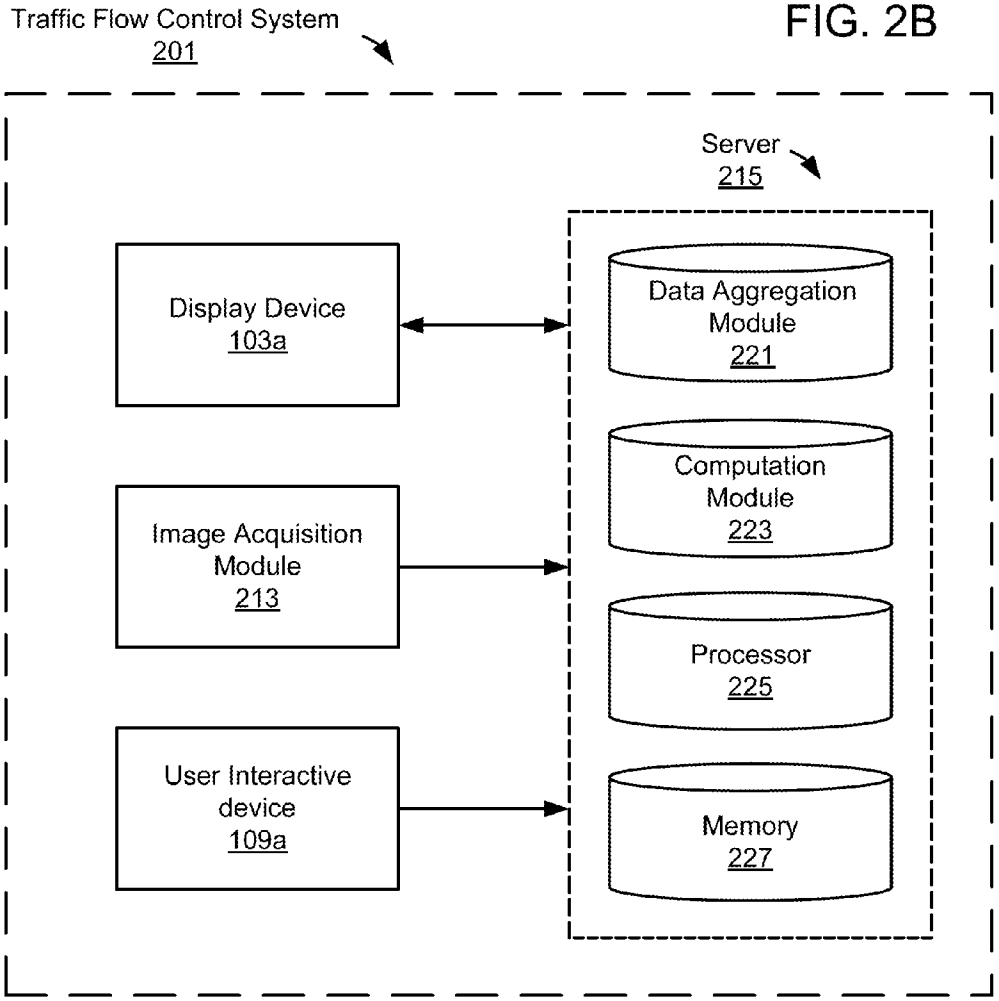
FIG. 2B shows a traffic flow control system according to one or more embodiments of the invention.

FIG. 2B shows a traffic flow control system according to one or more embodiments of the invention. The traffic flow control system (201) may comprise a display device (103*a*), an image acquisition module (213), an user interactive device (109*a*), sensor modules (not shown), and a server (215). The server (215) may comprise a data aggregation module (221), a computation module (223), a processor (225), and a memory (227). Each of these components is explained below; however, components that have already been described will be omitted for the sake of brevity.

As discussed, the image acquisition module (213) may be any image acquiring apparatus. In one or more embodiments, the image acquisition module (213) may be a camera, a heat-map generator, etc. The image acquisition module (213) may be configured to acquire a third set of data. In one or more embodiments, the third set of data may comprise a count of vehicles located at fork A. The count may be obtained, not only by the image acquisition module (213), but also by sensor modules (not shown) buried beneath a ground associated with fork A. Further, one of ordinary skill in the art would appreciate that sensor modules need not be located at or near the fork for which they are to be deployed. For example, they may be located 100 meters, 200 meters, 500 meters, etc., away from the fork A and be configured to measure traffic flow for vehicles going from fork A to another fork of the intersection. The image acquisition module (213), the sensor module (not shown), the display device (103*a*), the user interactive device (109*a*), etc., may communicate wired- or wirelessly with the server (215). For example, the image acquisition module (213) may forward the third set of data to the server (215). In one or more embodiments, the third set of data may comprise images, taken from close to a center of the intersection, of a fork, e.g., fork A. The third set of data may comprise a count of vehicles at fork A as well as a count of pedestrians located close to the user interactive devices (109*a*, 109*d*). In one or more embodiments, the third set of data may comprise a count of vehicles located at fork A. The count may be obtained by sensor modules buried beneath a ground associated with fork A.

In one or more embodiments, the user interactive devices (109*a*-109*d*) may be panels each having at least a button (not shown) for pedestrians to press to express interest in crossing at the intersection and a plurality of display icons. As discussed, the user interactive devices (109*a*-109*d*) may communicate wired- or wirelessly with the server (215). In one or more embodiments of the invention, the user interactive devices (109*a*-109*d*) may be used to signal pedestrians, cyclers, etc. Pedestrians may press the button of the user interactive devices (109*a*-109*d*) to indicate their desire to cross, thereby sending a fourth set of data to the traffic flow control system (201). The fourth set of data may comprise a time in which the pedestrian pressed the button. Upon pressing the button, a timer (which may or may not be shown to the user) of the user interactive device (109*a*) may count down. In one or more embodiments of the invention, the fourth set of data may comprise binary entries (the button is either pressed or not pressed).

The data aggregation module (221) may be a part of the server (215); the server may or may not be located separately from the display device (103*a*), the image acquisition module (213), and/or the user interactive device (109*a*). Likewise, the display device (103*a*) may or may not be located separately from the server (215), the image acquisition module (213), and/or the user interactive device (109*a*). The same may be true for the image acquisition module (213), the user interactive device (109*a*), etc.

In one or more embodiments, the data aggregation module (221) may obtain the first set of data, the second set of data, the third set of data, and the fourth set of data. In one or more embodiments, the data aggregation module (221) may standardize the various sets of data so that the entries may be further processed by the computation module (225) to arrive at a travel score for a particular travel direction.

In one or more embodiments, the computation module (223) may receive the various sets of data from the data aggregation module (221). In one or more embodiments, the computation module (223) may compute a travel score of a fork by adding the number of vehicles, the number of first type computing devices, the number of second type computing devices, etc. In one or more embodiments, in the event that two forks have equal numbers of first type computing devices and equal numbers of second type computing devices, the fork with more vehicles may be assigned a greater score. In one or more embodiments, the intersection may evaluate the third set of data and the fourth set of data and place more weight on the combination of the two and give higher priority to pedestrians wishing to cross. That is, the third set of data is able to image the number of pedestrians close to the user interactive devices and the fourth set of data is able to determine whether there are pedestrians wishing to cross at the intersection. Further, one of ordinary skill in the art would appreciate that each count (of the vehicle, of the first type computing device, of the second type computing device, etc.) may be weighed differently. For example, in one intersection, the number of vehicle may be weighed 90% in the travel score, whereas the summation of the first data set (the number of first type computing devices), the second data set (the number of second type computing devices), and the fourth data set (whether the button of the user interactive device has been pressed) weigh a meager 10%.

In one or more embodiments of the invention, the processor (225) may be an integrated circuit for processing instructions. For example, the processor (225) may be one or more cores, or micro-cores of a processor.

In one or more embodiments of the invention, the memory (227) may be, for example, random access memory (RAM), cache memory, flash memory, etc.

Turning to the flowcharts, while the various steps in the flowcharts are presented and described sequentially, one of ordinary skill will appreciate that some or all of the steps may be executed in different orders, may be combined or omitted, and some or all of the steps may be executed in parallel.

FIG. 3 shows a traffic flow control method according to one or more embodiments of the invention. The method shown in FIG. 3 may be implemented by the traffic flow control system (201).

In Step 301, a first set of data may be obtained from, e.g., a first type computing device, a second set of data may be obtained from, e.g., a second type computing device, a third set of data may be obtained from, e.g., an image acquisition module, a fourth set of data may be obtained from, e.g., an user interactive device. In one or more embodiments of the invention, the first set of data may be a count of the first type computing devices at fork A. In one or more embodiments of the invention, the second set of data may be a count of the second type computing devices at fork A. In one or more embodiments of the invention, the third set of data may be a heat map of fork A. In one or more embodiments of the invention, the third set of data may be a count of the vehicles of fork A. In one or more embodiments of the invention, the fourth set of data may be a binary input, indicating whether the button has been depressed or the button has not been depressed.

In Step 303, a travel score for fork A (either an aggregate of vehicles going straight or turning left or just those going straight or just those turning left) may be computed. The score may be weighted or may just be a simple count and rank protocol.

In Step 305, the traffic flow control system may determine, for example, whether the travel score for those turning left from fork A (AB) is the highest out of all travel scores for the intersection. Non-competing travel scores may also be summed as a unit for consideration by the traffic flow control system. For instance, a travel score for those at fork D going to fork B (DB) may be added to a travel score for those at fork B going to fork D (BD). The aggregate score may be compared to the summation of a travel score for those at fork D going to fork A (DA) and a travel score for those at fork B going to fork C (BC). If the travel score of DB (denoting travelling from D to B) plus BD is greater than DA plus BC, then the traffic flow control system may give higher priority to the DB and BD flow. In one or more embodiments, the travel score BD and DB may be summed with the travel score assigned to those pedestrians traveling from the user interactive device (109*c*) to the user interactive device (109*b*), and vice versa, as well as the travel score assigned to those pedestrians traveling from the user interactive device (109*a*) to the user interactive device (109*d*), and vice versa. The 6 travel scores are considered non-competing and may be added and compared to other travel scores. If the travel score is the highest travel score for the intersection, the flowchart may proceed to Step 311; if the travel score is not the highest score for the intersection, the flowchart may proceed to Step 307.

In Step 311, the traffic flow control system determines whether a restriction has been placed on the direction of travel. For example, if the traffic flow control system is enabling BD and DB flow, the DA flow is not permitted to flow even if it is the highest score. Thus, if it is determined that the DA flow is restricted by the BD and DB flow, the flowchart may continue to Step 313. If it is determined that the DA flow is not restricted, then the flowchart may continue to Step 309.

In Step 313, the DA flow is restricted and the flowchart may continue to Step 305.

In Step 307, the traffic flow control system determines whether a predetermined time has elapsed for the DA flow. If the predetermined time has not yet elapsed for the DA flow, the flowchart may return to Step 305; if the predetermined time has elapsed, the flowchart may continue to Step 309.

In Step 309, the traffic flow control system may determine whether a special vehicle is present by using the image acquisition module (213). In one or more embodiments, the special vehicle may be configured to communicate directly with the traffic flow control system governing the intersection. In one or more embodiments, the special vehicle may be an ambulance, a firetruck, or a police car. If the traffic flow control system determines that there is a special vehicle, then the flowchart may return to Step 307. If the traffic flow control system determines that there is no special vehicle, then the flowchart may proceed to Step 315.

In Step 315, the traffic flow control system may enable the DA flow.

While the disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered as examples because many other architectures can be implemented to achieve the same functionality.

The process parameters and sequence of steps described and/or illustrated herein are given by way of example only. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

Figure 4:
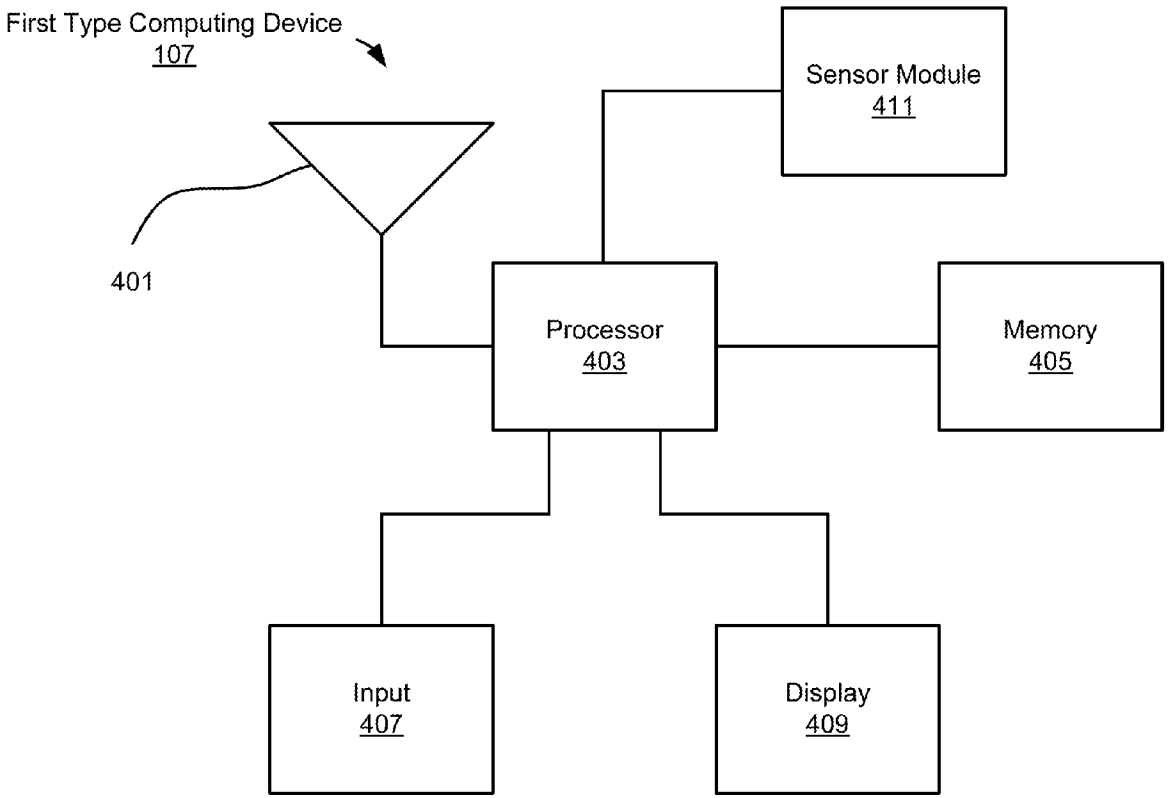
FIG. 4 shows a first type computing device according to one or more embodiments of the invention.

FIG. 4 shows a first type computing device according to one or more embodiments of the invention. Going forward, for the purposes of discussion only, the first type computing device is a global positioning system (107). One of ordinary skill in the art would appreciate that the global positioning system (107) is configured to position an object in a global geometric region. The global positioning system (401), in addition to receiving satellite data from satellites orbiting the Earth, may be configured to interface and communicate with the traffic flow control system and method discussed above.

As shown in FIG. 4, the global positioning system comprises various components including an antenna (401), a processor (403), a memory (405), an input (407), a display (409), and a sensor module (411). Each of these components is described in more details below.

In one or more embodiments of the invention, the antenna (401) enables the global positioning system (107) to receive radio waves from global positioning system satellites (not shown). The data communicated may include latitude data, longitude data, altitude data, weather data, etc.

In one or more embodiments of the invention, the processor (403) may be any type processor as discussed above. For example, the processor (403) may be an integrated circuit for processing instructions. For example, the processor (403) may be one or more cores, or micro-cores of a processor.

In one or more embodiments of the invention, the memory (405) may be, for example, random access memory (RAM), cache memory, flash memory, etc.

In one or more embodiments of the invention, the input (407) may be a touchscreen, keyboard, mouse, microphone, touchpad, electronic pen, or any other type of input device.

In one or more embodiments of the invention, the display (409) may be a cathode ray tube display (CRT), a light-emitting diode display (LED), an electroluminescent display (ELD), a plasma display panel (PDP), a liquid crystal display (LCD), an organic light-emitting diode (OLED), a laser color video display, an interferometric modulator display, head-up display (HUD), etc. Further, the display (409) may be a reconfigurable display in which a user/driver may select the type of view and the information to be displayed on the hardware display.

In one or more embodiments of the invention, the sensor module (411) may include one or more sensors—an infrared sensor, an accelerometer, a luminescence sensor, an image acquisition module (e.g., camera), etc. The sensor module (411) functions in conjunction with an environment of the global positioning system. For example, the luminescence sensor may be configured to alter a brightness of the display (409) based on the brightness of the immediate environment. Advantageously, this better assists the user to see the contents displayed on the display (409). For example, the accelerometer may be used to determine shock and vibration, thereby activating the global positioning system when engine vibration is detected.

One of ordinary skill in the art would appreciate that the global positioning system described above is not so limited and that other components may be a part of the system. For example, the global positioning system (107) may also comprise a communication module that enables cellular and/or internet communication. For example, the global positioning system (107) may also comprise other outputs (in addition to the display (409)) including an audio module.

Figure 5:
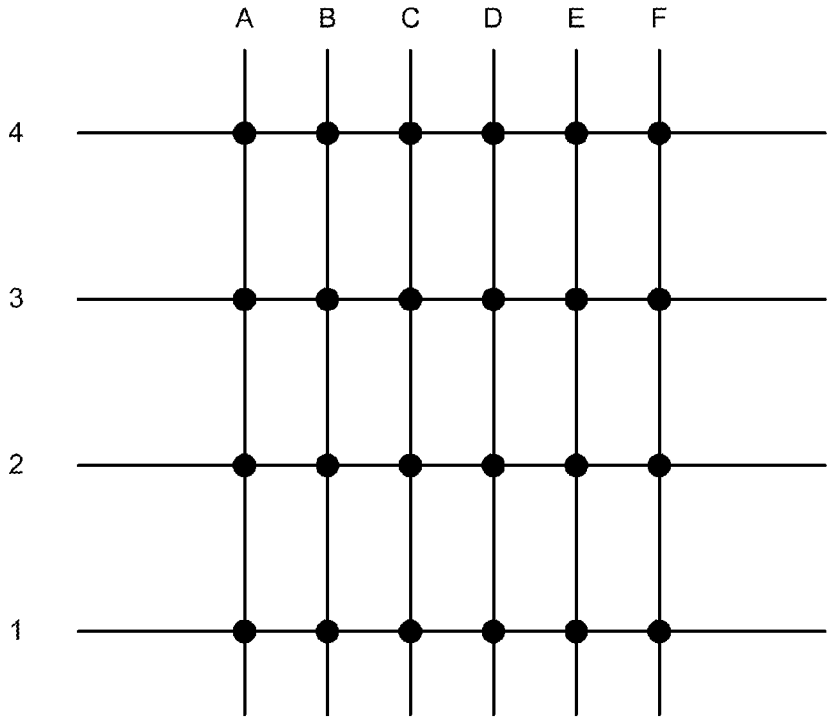

FIG. 5 shows an example city grid layout in which a first type computing device according to one or more embodiments of the invention can be deployed to assist a driver in navigation. For the purposes of discussion only, the first type computing device is a global positioning system.

FIG. 5 shows a city grid. Consider that each line intersection (e.g., A4, E1, etc.) is a traffic intersection and that each line is a route.

Consider a scenario in which Kevin is located at intersection F1 and intends to travel to intersection D2. There exist 4 non-repeating paths (i.e., paths in which Kevin does not travel to an intersection more than once) in which Kevin can travel. The 4 paths include: (1) F1→E1→D1→D2; (2) F1→E1→E2→D2; (3) F1→F2→E2→D2; and (4) F1→F2→E2→E1→D1→D2.

As opposed to conventional global positioning systems, the global positioning system according to one or more embodiments of the invention not only account for distance or estimated travel time, but also account for construction information, route information (e.g., presence of cyclists, joggers, etc.), weather information, congestion information, accident information, and other traffic information as received by each intersection equipped with the aforementioned traffic flow control system and method. Rather than just obtaining information from a traffic channel, one or more embodiments of the invention directly communicate with traffic flow control systems. Thus, the global positioning system according to one or more embodiments are able to know the length of a red light at a particular intersection, and so on. In one or more embodiments of the invention, route information may be continuously computed upon receipt of traffic information from the aforementioned control flow control system and method. In other embodiments, route information may be computed once every predetermined amount of time.

While the disclosure has been described with respect to a limited number of embodiments, those skilled in the art, having benefit of this invention, will appreciate that other embodiments can be devised which do not depart from the scope of the invention as disclosed herein.

For example, one of ordinary skill in the art would appreciate that the traffic flow control system and method may be amended to comply with the various regional traffic laws around the world. For example, one of ordinary skill in the art would appreciate that the global positioning system may be in any language and display traffic signs, points of interests, etc., using local symbol and convention.

For example, one of ordinary skill in the art would appreciate that the traffic flow control method described in FIG. 3 may be configured with other traffic protocols. That is, the intersection may utilize timers (i.e., 30 seconds for the first travel direction, then 30 seconds for the second travel direction, etc.) when the travel score is below a predetermined threshold and only switch to the method of FIG. 3 when the travel score is at or below the predetermined threshold.

For example, in one or more embodiments of the invention, the memory may be configured to store travel patterns of various directions and automatically enable the traffic flow control system to weigh and re-weigh the various sets of data according to time of day and historical data.

For example, in one or more embodiments, although FIG. 1A shows a DA flow on the D fork side having at least 11 first type computing device, the traffic flow control system may actually pick up 21 first type computing devices—11 within vehicles and 5 pedestrians in the proximity of the user interactive device (109*c*) and 5 pedestrians in the proximity of the user interactive device (109*d*). The image acquisition module may image the 10 pedestrians and subtract the pedestrians from the 21 first type computing devices initially picked up by the flow control system to arrive at an accurate count for the vehicles travelling in the DA flow and having the first type computing devices. This number may then be considered in view of the total number of vehicles, the number of second type computing devices, etc., to arrive at a travel score.

For example, in one or more embodiments, the number of vehicles is ranked higher than the number of first type computing devices; the number of first type computing devices is ranked higher than the number of second type computing devices; and, the number of second type computing devices is ranked higher than when the user interactive device indicates that a button thereof has been depressed. One of ordinary skill in the art would appreciate that any of the first set, second set, third set, and fourth set of data may be weighed anywhere between 0% and 100% with respect to one another.

For example, if two travel flows compete with one another, none of the two constitutes the highest travel score of the intersection, and both have waited for their predetermined time to elapse, the travel flow having the higher score may flow first before the travel flow with the lower score flows.

For example, when all non-highest travel directions have waited for their predetermined time to elapse, the travel flow with the highest score will wait until each of the non-highest travel directions flows once in accordance to their relative ranks—the higher the travel score, the higher the priority to flow.

For example, in one or more embodiments, all the travel scores of an intersection may be added to compute an intersection score. Intersection scores for a plurality of intersections may be computed to optimize travel flow in a section of a city. In one or more embodiments, geo-fences may be created (using intersections as centers, for example) to determine traffic flow in an area encompassing multiple intersections. Using global positioning system data obtained from the second set of data and vehicle counts using the third set of data, the traffic flow control system and method thereof can be expanded to cover not only a single intersection, but an area having a plurality of intersections. The same thing can be said when expanding coverage from these small regions to a whole metropolis, thereby optimizing travel time and reducing traffic congestion for the whole metropolis.

For example, in one or more embodiments, travel scores, intersection scores, etc., may be forwarded to global positioning systems, map applications, etc., to provide and/or optimize route conditions, travel time estimations, etc.

For example, although FIG. 1A shows a traffic flow control system being applied to an intersection having four forks, the invention is not limited thereto. One of ordinary skill in the art would appreciate that the traffic flow control system and method thereof may be applied to any situation in which prioritization of traffic flow is required. For example, the traffic flow control system and method thereof may be applied to airports, aircraft carriers, harbors, race tracks, intersections with one or more forks, railroads, hyperloop, etc.

For example, in one or more embodiments, the first set of data and/or the second set of data may be directly obtained from transmission systems, global positioning systems, etc., built in the vehicles themselves. For example, the vehicle may be a self-driving car that communicates with the traffic flow control system.

For example, the camera of the sensor module (411) may be configured to detect an eye contact from the user and, upon detecting that the user has made eye contact with the camera, cause an audio prompt to be voiced. The audio prompt may be a traffic condition, an upcoming instruction (e.g., turn right on Kevin Avenue in 500 meters), an estimated time of arrival (ETA). In one embodiment, the camera is disposed such that it has a field of view covering passenger windows and the rear windshield of a vehicle. And, when the camera detects an eye contact of the driver and the presence of a vehicle through the passenger windows and/or the rear windshield, the global positioning system (107) may, through the display (409) and/or the audio module, warn the driver of the same.

For example, the global positioning system may operate only when the camera of the sensor module detects presence of a driver. For example, the global positioning system may only operate when the camera of the sensor module detects presence of a registered driver. And, when the camera of the sensor module does not detect presence of a registered driver and detects a driver, the global positioning system may be configured to notify one or more registered drivers regarding possible theft. Such a warning message may be sent if an entered location appears to be suspicious from normal activity (e.g., outside a typical destination state, outside a registered home state).

For example, the global positioning system may be configured to be in an active or an inactive state. And, the global positioning system may only be activated through voice recognition. For example, the global positioning system may only be activated through password protection, which may be in the form of gesture, voice, fingerprint, etc. For example, the global positioning system may only be activated when it is within a recognized vehicle (which is not limited to passenger cars, and may be trucks, boats, RVs, etc.). Recognition may be accomplished through image processing techniques done on interior of a vehicle or detection of engine rhythm.

For example, the audio prompt may be broadcasted when the eye contact made is above a predetermined time threshold.

For example, the audio module, based on a surrounding of the global positioning system, may be configured to broadcast locations of interest in the surrounding. The broadcast may be, for example, 50% off at What-the-Burger when purchase is over $20. The broadcast may be, for example, buy an adult ticket and get a child ticket free. The audio module may, upon determining that a user is hungry (e.g., detecting that someone in the vehicle has stated that "I am hungry, can we stop somewhere close to get food?") be configured to recommend restaurants based on previous stored locations, based on nearby restaurant offerings, etc.

For example, the audio module, based on the surrounding of the global positioning system, route of travel, etc., may, in combination with user purchase behavioral data, broadcast advertisements for products that are relevant to the user. For example, by obtaining purchase data from a financial application like Mint (executing on a computing device), the global positioning system may determine that grocery purchases are made every Wednesday or approximately once every two weeks by wired- or wirelessly communicating with the computing device. Accordingly, when the user has not made his or her purchase within a determined time window, the global positioning system may prompt the user to do so and indicate the closest grocery store. In one or more embodiments, based on the purchase data, the audio module of the global positioning system may be configured to broadcast advertisements of stores (or similar stores) that were visited by the user.

For example, the audio module may enable not just broadcasting of audio prompts, but also receiving of audio queues from users regarding inputting address, querying next action (e.g., What is the next step? In how many miles is there a gas station?).

For example, even if the user is not actively using the global positioning system in an active state, the global positioning system may still be recording its position and the routes traveled to provide refined advertisements, etc.

Furthermore, one of ordinary skill in the art would appreciate that certain "components", "units", "parts", "elements", "modules", or "portions" of one or more embodiments of the present invention may be implemented by a circuit, processor, etc., using any known methods. Accordingly, the scope of the invention should be limited only by the attached claims.

What is claimed is:

1. A global positioning system comprising:

a processor that determines a route of travel using satellite data comprising a current location of the global positioning system and traffic data obtained from a traffic flow control system and a display that displays the current location and a modified route of travel, wherein the traffic data comprises restriction data, wherein the modified route of travel is determined using the restriction data, and wherein the restriction data comprises a count of pedestrians that is above a predetermined threshold.

2. The global positioning system according to claim 1, wherein:

the traffic data comprises a first set of data from a first type computing device and a second set of data from a second type computing device, a data entry of the first set of data comprises a count of mobile devices, a data entry of the second set of data comprises the count of pedestrians, and the processor determines the modified route of travel by comparing the count of mobile devices to the count of pedestrians, each of the count of mobile devices and the count of pedestrians being associated with an intersection of the route of travel.

3. The global positioning system according to claim 1, wherein the restriction data further comprises at least one selected from a group consisting of: construction information, accident information, presence of a special vehicle, weather information, and route information.

4. The global positioning system according to claim 3, wherein the route information indicates presence of a pedestrian or presence of a cyclist.

5. The global positioning system according to claim 3, wherein the special vehicle is at least one selected from a group consisting of: an ambulance, a fire truck, a police car, and a bicycle.

6. The global positioning system according to claim 1 further comprising a sensor and a speaker.

7. The global positioning system according to claim 6, wherein, upon the sensor detecting at least one selected from a group consisting of an eye contact, an audio queue, and a gesture from a user, the processor causes the speaker to provide an audio prompt.

8. The global positioning system according to claim 7, wherein the audio prompt is at least one selected from a group consisting of: a weather condition, an advertisement, a traffic condition, an upcoming instruction, and an estimated time of arrival.

9. The global positioning system according to claim 7, wherein the audio prompt is a blind spot warning prompt if the sensor detects presence of an object of interest outside a passenger window or outside a rear windshield of an equipped vehicle.

10. The global positioning system according to claim 1, wherein the global positioning system is at least one selected from a group consisting of: integrated with a vehicle and a smart phone.

11. The global positioning system according to claim 1, wherein the processor causes the global positioning system to be in an active or an inactive mode.

12. The global positioning system according to claim 11, wherein the global positioning system is in the active mode if the processor determines that the global positioning system is disposed in a registered vehicle.

13. The global positioning system according to claim 7, wherein the audio prompt is an advertisement associated with a surrounding location of interest.

14. The global positioning system according to claim 11, wherein:

the processor causes the global positioning system to be in the active mode if the sensor detects presence of a registered user and the processor causes the global positioning system to be in the inactive mode if the sensor does not detect the presence of the registered user.

15. The global positioning system according to claim 11, wherein the processor generates and transmits a theft report to a registered user when a predetermined condition is met.

16. The global positioning system according to claim 15, wherein:

the theft report comprises the current location and a field of view of a camera of the global positioning system and the predetermined condition is at least one selected from a group consisting of: when the global positioning system receives an unregistered address input and when the processor fails to determine presence of a registered user.

17. A method comprising:

receiving satellite data;

determining a route of travel using the satellite data;

receiving a traffic data from a traffic flow control system;

modifying the route of travel using the traffic data; and displaying a current location and a modified route of travel, wherein the traffic data comprises restriction data, wherein the modified route of travel is determined using the restriction data, and wherein the restriction data comprises a count of pedestrians that is above a predetermined threshold.

18. The method according to claim 17, wherein:

the traffic data comprises a first set of data from a first type computing device and a second set of data from a second type computing device, a data entry of the first set of data comprises a count of mobile devices, a data entry of the second set of data comprises the count of pedestrians, and the modifying modifies the route of travel by comparing the count of mobile devices to the count of pedestrians, each of the count of mobile devices and the count of pedestrians being associated with an intersection of the route of travel.

19. A non-transitory computer readable medium comprising computer readable program code, which when executed by a computer processor, enables the computer processor to:

receive satellite data;

determine a route of travel based on the satellite data;

receive a traffic data from a traffic flow control system;

modify the route of travel using the traffic data; and cause a current location and a modified route of travel to be displayed on a display, wherein the traffic data comprises restriction data, wherein the modified route of travel is determined using the restriction data, and wherein the restriction data comprises a count of pedestrians that is above a predetermined threshold.

20. The non-transitory computer readable medium according to claim 19, further enables the computer processor to:

detect at least one selected from a group consisting of an eye contact, an audio queue, and a gesture from a user and broadcast an audio prompt, wherein the audio prompt is a blind spot warning prompt if the sensor detects presence of an object of interest outside a passenger window or outside a rear windshield of an equipped vehicle.

* * * * *